United States Patent [19]

Watanabe et al.

[11] 4,238,005

[45] Dec. 9, 1980

[54] DECELERATION CONTROLLING APPARATUS FOR ELEVATOR

[75] Inventors: Eiki Watanabe; Nobuo Anzai, both of Inazawa, Japan

[73] Assignee: Mitsubishi Denki Kabushiki Kaisha, Tokyo, Japan

[21] Appl. No.: 940,770

[22] Filed: Sep. 8, 1978

[30] Foreign Application Priority Data

Sep. 21, 1977 [JP] Japan ..... 52-113572

[51] Int. Cl.[3] ..... B66B 1/32

[52] U.S. Cl. ..... 187/29 R

[58] Field of Search ..... 187/29; 318/371; 363/70

[56] References Cited

U.S. PATENT DOCUMENTS

| | | | |
|---|---|---|---|
| 2,712,365 | 7/1955 | Bruns | 187/29 |
| 3,713,012 | 1/1973 | Johnson | 363/70 |
| 3,779,346 | 12/1973 | Winkler | 187/29 |
| 4,074,176 | 2/1978 | Parke et al. | 318/371 |

FOREIGN PATENT DOCUMENTS

| | | | |
|---|---|---|---|
| 996238 | 8/1976 | Canada | 318/371 |

*Primary Examiner*—Gene Z. Rubinson
*Assistant Examiner*—W. E. Duncanson, Jr.
*Attorney, Agent, or Firm*—Oblon, Fisher, Spivak, McClelland & Maier

[57] ABSTRACT

A deceleration controlling apparatus for an elevator is to prevent excess regenerative current by applying a friction type brake at a specific intensity to a motor for driving a cage during an abnormal deceleration at speed of the cage that is faster than the normal speed for the terminal floor deceleration by a failure in landing the cage on the terminal floor.

5 Claims, 4 Drawing Figures

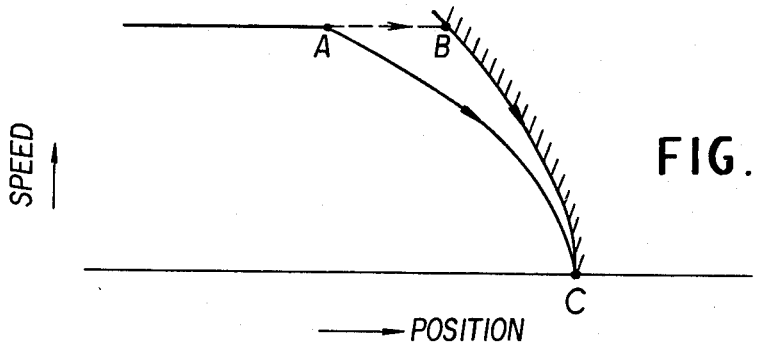
FIG. 1
FIG. 2
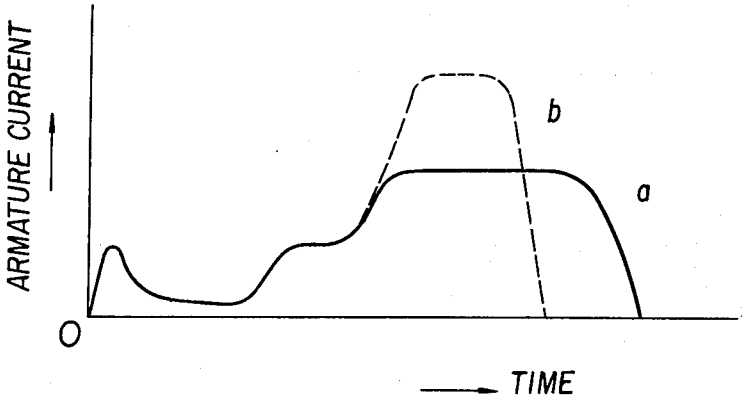
FIG. 4
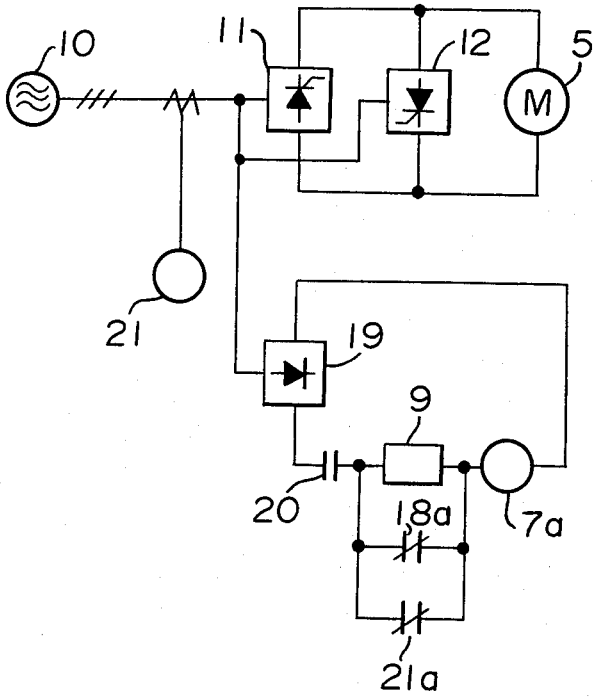

DECELERATION CONTROLLING APPARATUS FOR ELEVATOR

BACKGROUND OF THE INVENTION

The present invention relates to an improvement of a deceleration controlling apparatus for an elevator.

It is a duty to equip a terminal stopping device in order to maintain the safety of an elevator.

The terminal stopping device is to land the cage on the terminal floor in safety when the cage approaches near the terminal floor even though the cage could not be decelerated by a normal stopping means because of certain failure.

FIG. 1 shows the principal.

In FIG. 1, the curve $\overrightarrow{AC}$ is a speed curve given by a normal stopping means; and the curve $\overrightarrow{BC}$ is a speed curve given by a terminal stopping device.

During the normal operation, the cage is decelerated at suitable decelerating speed as the curve $\overrightarrow{AC}$ by the below mentioned normal stopping means. However, when the cage runs as the curve $\overrightarrow{AB}$ because of certain failure, the normal stopping means is switched to the terminal stopping device. The cage is further decelerated as the curve $\overrightarrow{BC}$ to land on the terminal floor.

As it is clear from the description, the deceleration as the curve $\overrightarrow{BC}$ is remarkably higher than the deceleration as the curve $\overrightarrow{AC}$ as about two times in usual.

In the overload descending operation of the cage, a significantly large regenerative current is passed through the motor in said condition. The fact is shown in FIG. 2.

In FIG. 2, currents in an armature of a DC motor for driving the cage of the elevator are shown and the curve (a) designates the current in the normal deceleration and the curve (b) designates the current corresponding to that of the deceleration by a terminal stopping device.

Recently, a static Leonard system using a thyristor has been used for a controlling apparatus of the elevator. In order to pass such large current during the terminal stopping, it is necessary to use a thyristor which is durable to the large current and it is uneconomical.

There is also a possibility of causing a flash-over of the motor to such large current because of a failure of commutation.

On the other hand, when the decelerating speed during the terminal stopping, is decreased, the curve $\overrightarrow{AC}$ approaches to the curve $\overrightarrow{BC}$ whereby the terminal stopping device is actuated in many times by slight drifts. In usual, the feeling in the terminal stopping is significantly inferior to the feeling in the normal stopping. Accordingly, such erroneous actuations are disadvantageous.

SUMMARY OF THE INVENTION

It is an object of the present invention to provide a deceleration controlling apparatus for an elevator which prevents the passing of a large current through a motor without decreasing a decelerating speed during an abnormal deceleration such as the terminal stopping.

The foregoing and other objects of the present invention have been attained by providing a deceleration controlling apparatus for an elevator which comprises a friction type brake for applying a braking torque to a motor for driving a cage; a deceleration detector for detecting a deceleration at a speed of the cage over the normal deceleration; a regeneration discriminating circuit for discriminating the regenerative operation of the motor; and a braking torque controlling circuit which applies a braking torque to the motor by the friction type brake when both the deceleration detector and the regeneration discriminating circuit are operated.

In a modification of the above, a device for detecting the regenerative condition of the motor is used instead of the deceleration detector and the braking torque is applied by the operation of both the regeneration discriminating circuit and the regenerative condition detector.

BRIEF DESCRIPTION OF THE DRAWINGS

FIG. 1 is a graph of curves of terminal floor decelerating speeds of a cage of an elevator;

FIG. 2 is a graph of curves of currents passed through an armature of a DC motor for driving the cage;

FIG. 4 is a diagram of an important part of the other embodiment of the present invention.

DETAILED DESCRIPTION OF THE PREFERRED EMBODIMENTS

Figure 3:
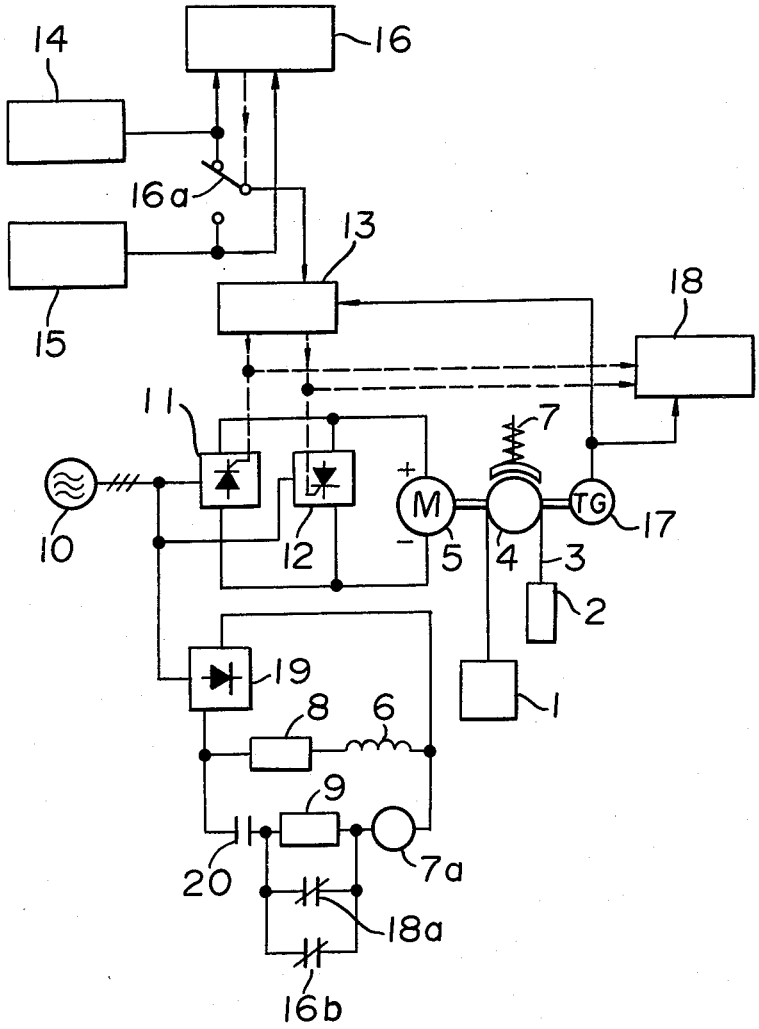
FIG. 3 is a diagram of one embodiment of the deceleration controlling apparatus according to the present invention.

Referring to FIG. 3, one embodiment of the present invention will be illustrated.

In FIG. 3, the reference numeral (1) designates a cage of an elevator; (2) designates a counterweight; (3) designates a main rope; (4) designates a driving sheave; (5) designates an armature of a DC motor for driving the driving sheave (4); (6) designates a field for the motor; (7) designates a friction type brake; **(7*a*)** designates a brake coil.

The friction type brake (7) releases the armature (5) by exciting the brake coil **(7*a*) whereas the friction type brake (7) imparts braking torque to the armature (5) by extinguishing the brake coil (7*a*)**.

The reference numerals (8) and (9) designate resistors; (10) designates a three phase AC power source; (11) and (12) designate thyristor converters; (13) designates a firing circuit for controlling the thyristor converters (11), (12); (14) designates a normal stopping means (15) designates a terminal stopping device; (16) designates a terminal stopping detector; **(16*a*) designates a switching contact for the output; (16*b*) designates a normally closed contact; (17) designates a tachometer driven by the armature (5); (18) designates a regeneration discriminating circuit for discriminating the regenerative operation; (18*a*) designates a normally closed contact for the output; (19) designates a rectifying circuit; (20) designates a brake releasing relay contact which is closed during the running of the cage (1)**.

The operation of the embodiment will be illustrated.

When the cage (1) is started, the brake releasing relay contact (20) is closed whereby the brake coil **(7*a*) is excited by the circuit (19)-(20)-(16*b*)-(7*a*)-(19) to release the armature (5)**.

On the other hand, the alternative current fed from the three phase AC power source (10) is rectified to direct current by the thyristor converters (11), (12). The armature (5) is driven by the direct current whereby the cage (1) is run through the driving sheave (4).

The firing angles of the thyristor converters (11), (12) are controlled by the output of the firing circuit (13) whereby the conventional speed control of the cage is performed. When the cage (1) approaches near the terminal floor, the output of the normal stopping means (14) is input through the switching contact (16*a*) to the firing circuit (13) whereby the cage (1) is decelerated as the curve $\overrightarrow{AC}$ of FIG. 1 to land on the terminal floor C.

The static Leonard system shown in FIG. 3 is referred to as a non-circulating current system wherein the firing signal is fed to only one of the two thyrsitor converters (11), (12) but it is not fed to the other.

When the polarity of the terminal voltage of the armature (5) is shown in FIG. 3 during the running of the cage (1), the firing circuit (13) is automatically operated so that the firing signal is fed to the thyristor converter (11) during the power running whereas the firing signal is fed to the thyristor converter (12) during the regenerative operation.

The polarity of the terminal voltage of the armature (5) is known by the polarity of the output voltage of the tachometer (17). Accordingly, the regeneration discriminating circuit (18) discriminates whether the armature (5) is in the power running operation or in the regenerative operation by the polarity of the output of the tachometer (17) and the signal for indicating the thyristor converter (11) or (12) to which the firing signal is fed.

When the cage (1) approaches near the terminal floor, if the cage (1) runs as $\overrightarrow{AB}$ of FIG. 1 under certain failure, it is given to be that the output of the normal stopping means (14) is greater than (>) the output of the terminal stopping device (15). The fact is detected by the terminal stopping detector (16) whereby the switching contact (16*a*) is switched to the terminal stopping device (15) and simultaneously, the contact (16*b*) is opened.

In said case, when the armature (5) is in the regenerative operation, the regeneration discriminating circuit (18) is operated as described and the contact (18*a*) is opened. As the result, the current passed through the brake coil (7*a*) is decreased by the resistor (9) whereby the releasing of the armature (5) by the friction brake (7) is not complete to impart certain braking torque. Accordingly, the armature (5) is decelerated whereby the regenerative current can be remarkably decreased even in the regenerative operation.

When it is not in the regenerative operation, the contact (18*a*) is closed even in the terminal stopping whereby the braking torque is not applied by the friction brake (7) because the current at the terminal stopping in the power running operation is quite small in comparison with that of the regenerative operation.

FIG. 4 shows the important feature of the other embodiment of the present invention.

In FIG. 4, the reference numeral (21) designates a current detector in an AC line; (21*a*) designates a normally closed contact and the other parts are substantially the same with those of FIG. 3.

In the embodiment, the current for opening the contact (18*a*) is passed during the regenerative operation, and the current detector (21) is actuated to open the contact (21*a*). Accordingly, the current passed through the brake coil (7*a*) is decreased by the resistor (9) as the same in FIG. 3 whereby the braking torque of the friction brake (7) is applied to the armature (5).

The times of the decelerations by the friction brake (7) is reduced because the times of the decelerations are limited only to pass a large current whereby the life of the friction brake (7) is prolonged.

It is possible to detect the acceleration instead of detecting the current. The acceleration signal can be obtained by a differentiation of the output of the tachometer (17).

In these embodiments, the regenerative operation is discriminated by the firing signal of the thyristor converters (11), (12) and the running direction of the cage (1). However, a large regenerative current is usually fed during a non-load ascending operation of the cage (1) or an overload descending operation of the cage (1). Accordingly, the regeneration discriminating circuit (18) can have the structure for discriminating the regenerative operation by the load in the cage (1) and the direction of the cage (1). The circuit for the structure is simple and easily conceived by a person skilled in the art.

In these embodiments, the terminal stopping is discussed. Thus, it can be applied for various decelerations without limiting the feature of the terminal stopping. For example, it can be applied in the landing of the cage on the nearest floor under unusual deceleration when an earthquake or some other accident is happening.

In accordance with the present invention, the braking torque is applied to the armature by a friction brake when the regenerative operation of the motor is performed during the deceleration at the speed of the cage over the normal deceleration whereby the large current during the regenerative operation can be remarkably decreased to prevent the flash-over of the motor.

What is claimed is:

1. A deceleration controlling apparatus for an elevator which comprises:

a friction type brake for applying a braking torque to a motor for driving a cage;

a deceleration detector for detecting a deceleration at a speed of the cage over a normal decelerating speed; said deceleration detector generating a signal whenever a normal stopping means is switched to a terminal stopping device;

a regeneration discriminating circuit for discriminating the regenerative operation of the motor; and a braking torque controlling circuit which applies a braking torque to the motor by the friction type brake when both the deceleration detector and the regeneration discriminating circuit are operated.

2. A deceleration controlling apparatus according to claim 1 which further comprises two thyristor converters, a static Leonard system with no circulating current for controlling the speed of the motor for driving the cage; and a tachometer driven by the motor for driving the cage, whereby the regenerative condition is discriminated by the regeneration discriminating circuit from a firing signal of the two thyristor converters and a polarity of an output voltage of the tachometer.

3. A deceleration controlling apparatus according to claim 1 wherein the regeneration discriminating circuit is to detect a load of the cage and a direction of the running of the cage.

4. A deceleration controlling apparatus according to claim 1 which further comprises a static Leonard system for controlling the speed of the motor for driving the cage, wherein the deceleration detector is a current detector connected to an AC line for the static Leonard system and the current detector detects the current over the specific value to generate the signal.

5. A deceleration controlling apparatus according to claim 1 wherein the deceleration detector generates a signal obtained by a differentiation of an output of the tachometer driven by the motor for driving the cage.

* * * * *